US006035753A

United States Patent [19]

Coffey

[11] Patent Number: 6,035,753

[45] **Date of Patent: *Mar. 14, 2000**

[54] PERFORATION ASSEMBLIES HAVING VARIABLE CUT TO TIE RATIOS FOR MULTI-PLY FORMS

[75] Inventor: James B. Coffey, Vandalia, Ohio

[73] Assignee: NCR Corporation, Dayton, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/711,355

[22] Filed: Sep. 5, 1996

[51] Int. Cl.[7] ..... B26F 1/20

[52] U.S. Cl. ..... 83/332; 83/660; 83/678

[58] Field of Search ..... 83/332, 660, 678, 83/695, 698.51, 699.41, 699.61

[56] References Cited

U.S. PATENT DOCUMENTS

| | | | |
|---|---|---|---|
| 526,347 | 9/1894 | Flynn . | |
| 3,463,039 | 8/1969 | Silver . | |
| 3,554,070 | 1/1971 | Boyd . | |
| 3,978,752 | 9/1976 | Meaden et al. . | |
| 3,978,753 | 9/1976 | Meaden et al. . | |
| 4,699,035 | 10/1987 | Gal et al. . | |
| 4,745,835 | 5/1988 | Schnitzer | 83/678 |
| 4,805,502 | 2/1989 | Ishigure . | |
| 5,029,506 | 7/1991 | Glendening | 83/678 X |
| 5,174,184 | 12/1992 | Meeks | 83/332 |

*Primary Examiner*—Kenneth E. Peterson
*Attorney, Agent, or Firm*—Charlene Stukenborg

[57] ABSTRACT

A multi-blade perforation assembly having either rotary or straight blades provides adjustable, small cut and tie ratios for multi-ply forms without diminishing the quality or reliability of the forms.

10 Claims, 9 Drawing Sheets

PERFORATION ASSEMBLIES HAVING VARIABLE CUT TO TIE RATIOS FOR MULTI-PLY FORMS

BACKGROUND OF THE INVENTION

The present invention relates to perforation wheels or straight blade assemblies having variable cut to tie ratios for multi-ply forms.

Commercially available perforation wheels or straight perforation blades (commonly referred to as cross perf. blades) of one piece construction have been used to produce perforation patterns for business forms, especially single-ply business forms. These commonly used perforation wheel blades or straight perforation blades have a fixed cut (tooth) to tie (space) ratio which cannot be varied after construction. These one piece blades may have the teeth cut at an angle to enable easier sharpening. Even if these blades could be varied, it is very difficult to build a perforating wheel blade or straight blade of one piece construction which can perforate multi-part (three to six parts) business forms which have a small cut and tie pattern. With a one piece construction, the cost escalates drastically and the method of construction becomes increasingly difficult as the cut and tie dimensions get smaller and as the depth of the tooth space increases.

If the tooth space and the cutting space are small and closely spaced, attempts to provide perforations in multi-ply forms with a perforation wheel or straight perforation blade will in most cases result in severed separate pieces for several of the parts rather than producing a clean cut perforation pattern. The depth of the tooth space must be increased as the number of parts in the multi-ply form increases. A small cut and tie is desirable as it produces an edge or boundary on a business form that is both attractive and clean cut with minimal torn or ragged edges. (Ragged edges are generally noticeable if the ties are 0.020 inches or larger).

The use of a small tie and a large cut to improve the appearance and functional characteristics of a form diminishes the physical strength of the form. Resulting breaks and tears restrict the use and handling characteristics of the forms. There is a need for perforation wheels and/or straight perforation blades which provides adjustable, small cut and tie ratios for multi-ply forms without diminishing the quality or reliability of the forms.

SUMMARY OF THE INVENTION

In accordance with the teachings of the present invention, a perforation assembly having multiple blades for forming adjustable cut and tie ratios for multi-ply forms is provided.

It is an important feature of the present invention that smaller and deeper tooth space can be achieved with the two piece cutting blade assemblies.

It is accordingly an object of the present invention to provide a perforation assembly having a pair of rotary blades for providing adjustable cut and tie ratios for multi-ply forms.

It is another object of the present invention to provide a perforation assembly having a pair of straight blades for providing adjustable cut and tie ratios for multi-ply forms.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION OF THE PREFERRED EMBODIMENT

Figure 1A:
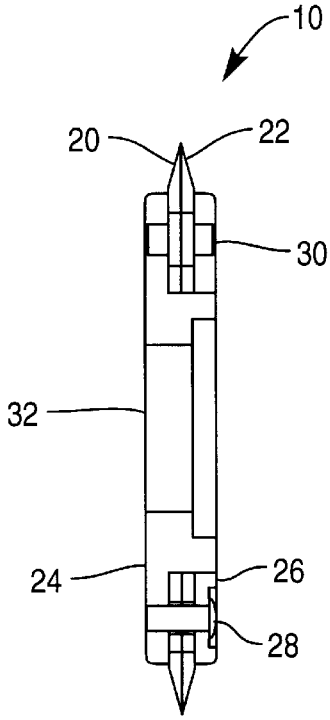
FIGS. 1A, 1B and 1C are views of the perforation wheel assembly according to a first embodiment of the present invention.
Figure 1B:
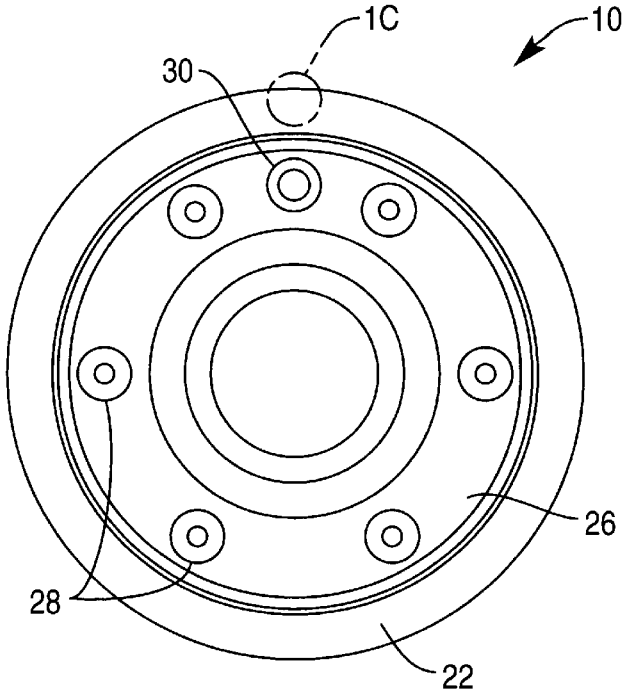
Figure 1C:
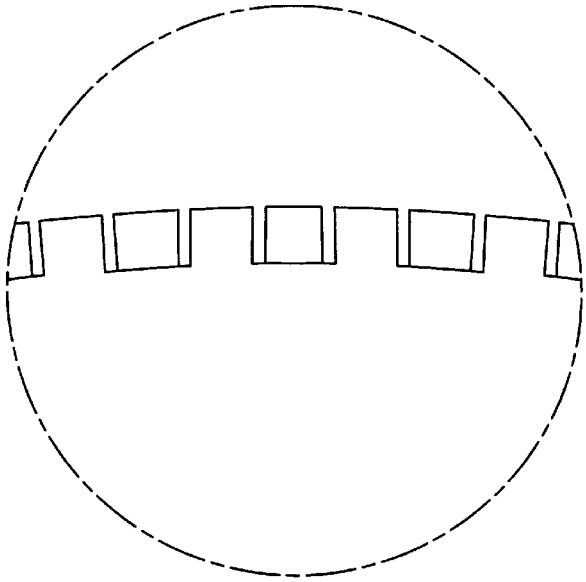

Referring now to the drawings, in which like-referenced characters indicate corresponding elements throughout the several views, attention is first drawn to FIGS. 1A, 1B and 1C which show the perforation wheel assembly of a first embodiment of the present invention. Perforation wheel assembly 10 includes a pair of perforation wheel blades 20 and 22. The pair of perforation wheel blades 20 and 22 mount on a perforation wheel mounting hub 24. A perforation wheel retainer plate 26 also mounts on the perforation wheel mounting hub 24 to secure the blades 20 and 22 in the assembly. Fasteners 28, such as screws, are used to hold the assembly together. A perforation wheel eccentric pin 30 provides a means for adjusting the angular relationship between the pair of perforation wheel blades 20 and 22. Perforation wheel assembly 10 also includes a center mounting hole 32 for mounting the perforation wheel assembly on a tool.

Figure 2A:
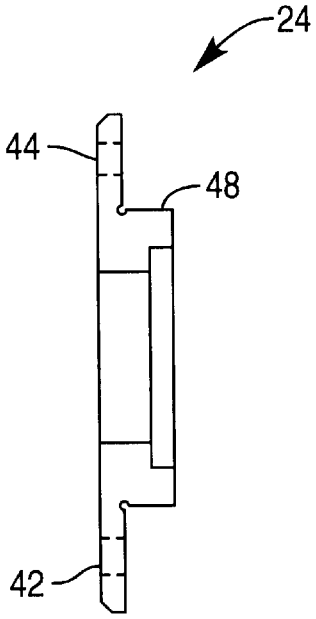
FIGS. 2A and 2B are a detailed views of a perforation wheel mounting hub of the perforation wheel assembly.
Figure 2B:
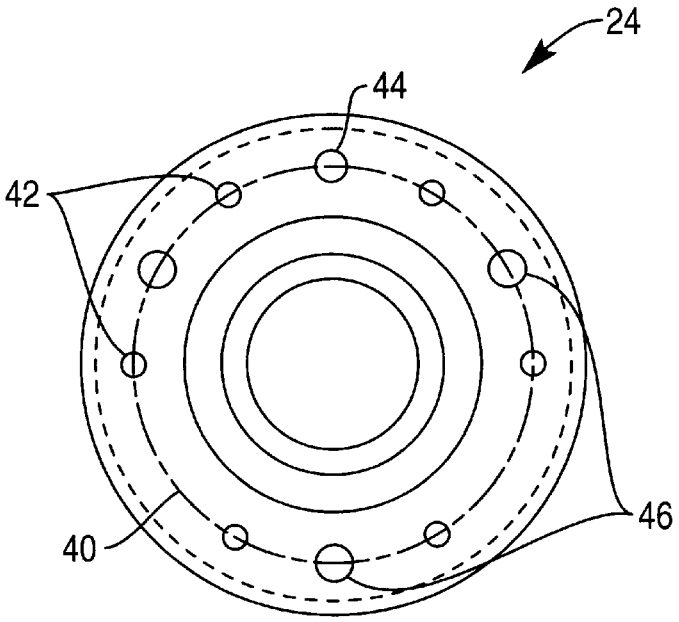

FIGS. 2A and 2B show a detailed view of hub 24. Hub 24 has a center shaft 48 upon which the blades 20 and 22 are centered. Hub 24 preferably has a diameter of about 2.5 inches. Shaft 48 preferably has an outer diameter of 1.5 inches. Hub 24 includes a concentric bolt circle. Bolt circle 40 includes six equally spaced holes 42 preferably having a #5-40 tap for receiving fasteners 28. Between two of the six holes is a larger hole 44 for the eccentric pin 30. Also on the bolt circle 40 are three equally spaced holes preferably located between the six holes but not where the eccentric pin hole 44 is located. These three equally spaced holes 46 are used to hold the assembly during adjustment. Hub 24 is preferably formed of hardened steel or any other material suitable for the precision machining required.

Figure 3A:
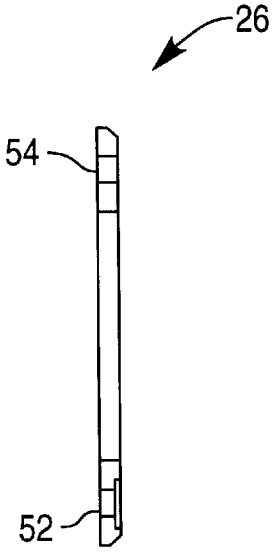
FIGS. 3A and 3B are detailed views of a perforation wheel retainer plate of the perforation wheel assembly.
Figure 3B:
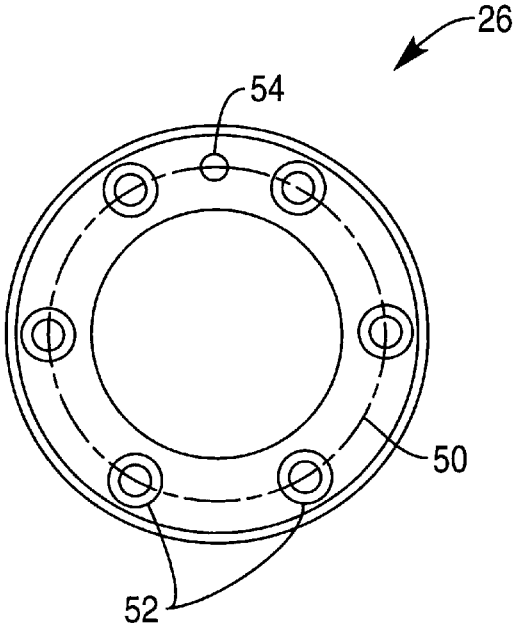

Referring to FIGS. 3A and 3B a detailed view of the perforation wheel retainer plate 26 is shown. Plate 26 also has a bolt circle 50 corresponding to the bolt circle 40 of hub 24. Bolt circle 50 includes six equally spaced thru holes 52 having counterbores for receiving fasteners 28. Bolt circle 50 also includes a larger hole 54 for the eccentric pin 30. Plate 26 is centered on the center shaft of hub 24. Plate 26 is preferably formed of hardened steel or any other material suitable for the precision machining required.

Figure 4A:
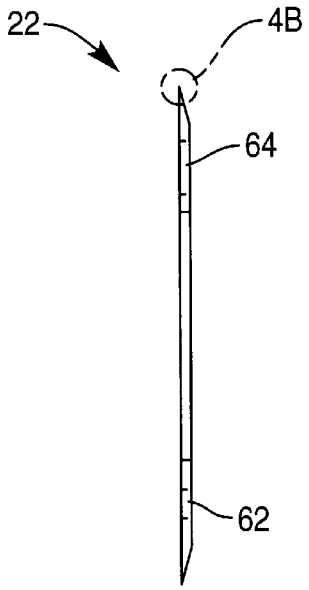
FIGS. 4A, 4B, 4C and 4D are detailed views of a first blade of the perforation wheel assembly.
Figure 4C:
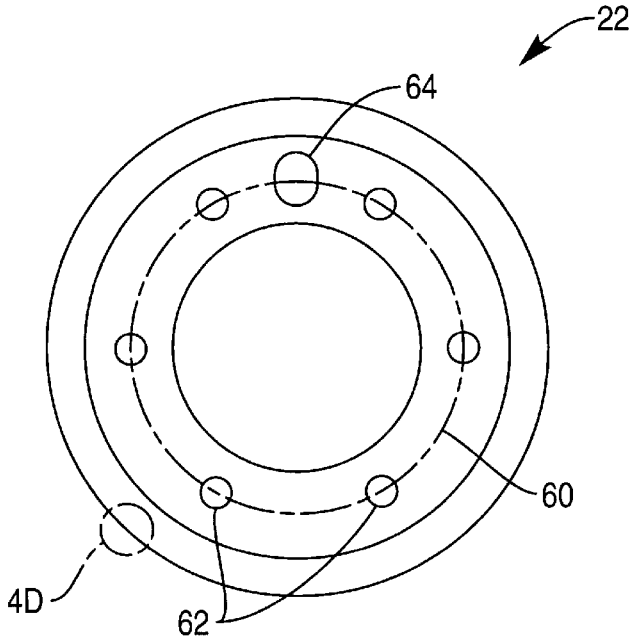
Figure 4B:
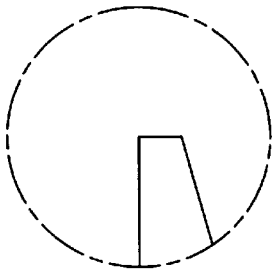
Figure 4D:
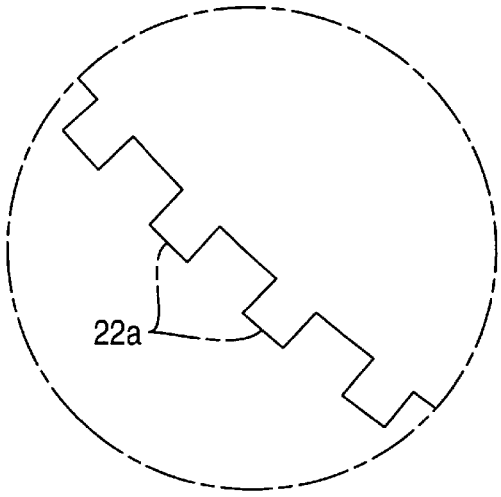

FIGS. 4A, 4B, 4C, 5A, 5B and 5C show detailed views of the blades 20 and 22. Blades 20 and 22 are preferably formed from AISI M2 high speed tool steel. Blades 20 and 22 each have a beveled edge preferably having a 15 degree angle from a small flattened area at the tip of each blade (as shown in FIG. 4B). Each of the blades 20 and 22 have teeth (22*a* and 20*a*) formed in the periphery of each of the blades. FIGS. 4A, 4B, 4C and 4D show the first blade 22. First blade 22 has a bolt circle 60 including six equally spaced thru holes 62 for receiving fasteners 28 but having a gap between the periphery of the thru holes and the fasteners 28 to allow adjustment of the blades 20 and 22 with respect to the angular relationship of each blade. Bolt circle 60 also includes a larger slot 64 for the eccentric pin 30. Blade 22 is centered on the center shaft of hub 24.

Figure 5A:
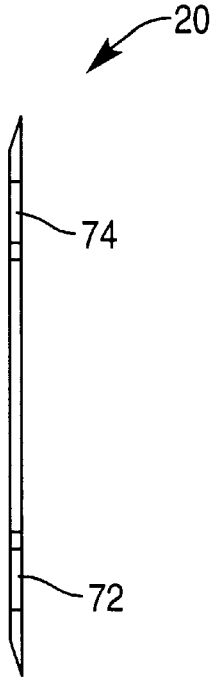
FIGS. 5A, 5B, and 5C are detailed views of a second blade of the perforation wheel assembly.
Figure 5B:
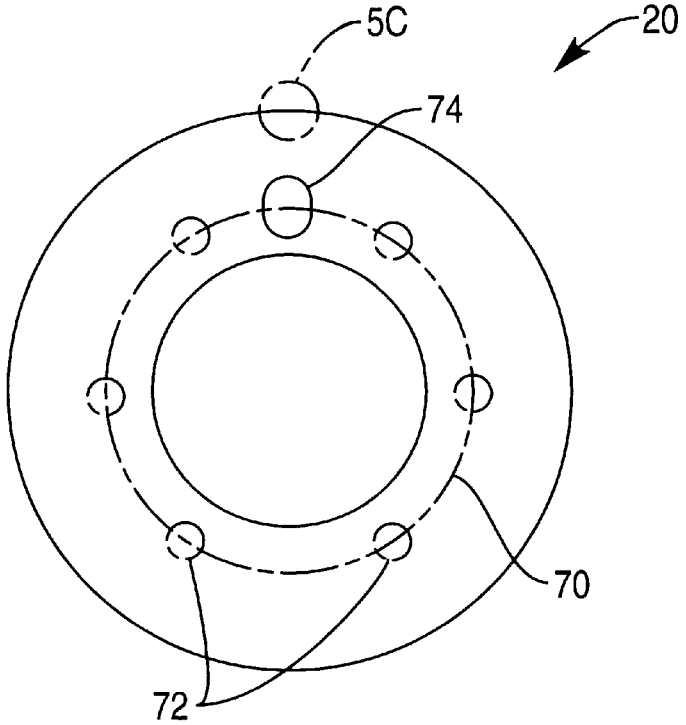
Figure 5C:
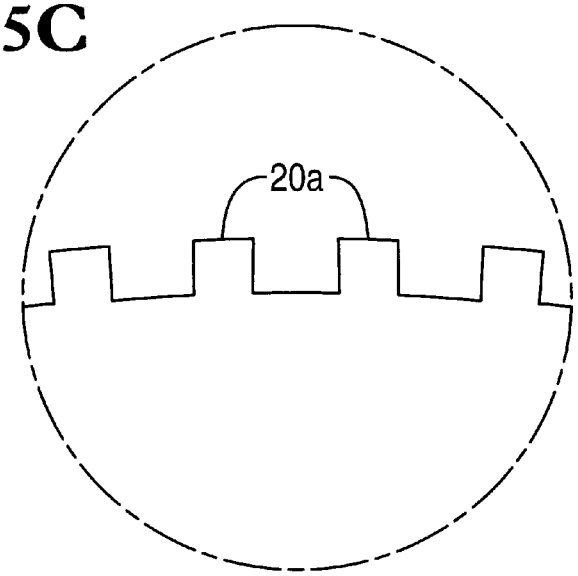

FIGS. 5A, 5B and 5C show the second blade 20. Second blade 20 has a bolt circle 70 including six equally spaced holes 72 for receiving fasteners 28 but having a gap between the periphery of the holes and the fasteners 28 to allow adjustment of the blades with respect to the angular relationship of each blade. Bolt circle 70 also includes a larger slot 74 for the eccentric pin 30. Blade 20 is centered on the center shaft of hub 24. Blades 20 and 22 are assembled so the flattened areas at the tips align and the beveled edge of each blade cooperates to form a beveled cutting edge. Blades 20 and 22 preferably include 120–240 teeth around the periphery, but the number of teeth may be selected for achieving desired results.

Figure 6:
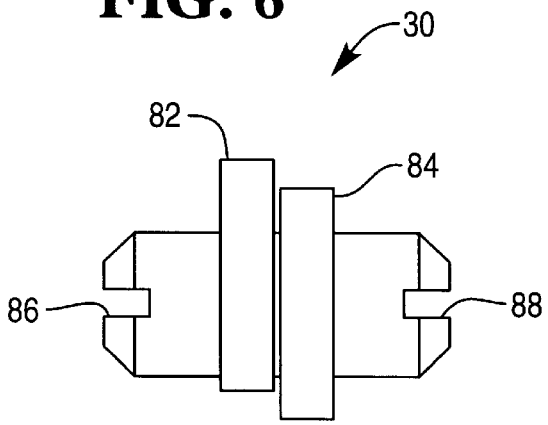
FIG. 6 is a detailed view of an eccentric pin of the perforation wheel assembly.

FIG. 6 shows the eccentric pin 30 which fits into the eccentric pin holes/slots 44, 54, 64, and 74 of hub 24, plate 26 and blades 22 and 20 respectively. Eccentric pin 30 has two separate diameter collars or raised machined surfaces 82 and 84. These two collars are offset relative to each other, with collar 84 being concentric with the shafts having slots 86 and 88 and collar 82 being eccentric with the shafts having slots 86 and 88. These two collars 82 and 84 locate each of the cutting blades 20 and 22 in position about the center hub. Collar 84 fits into slot 64 on bolt circle 60 and collar 82 fits into slot 74 on bolt circle 70 and locates and adjusts the angular position of the adjustable blades 20 and 22. Each end of eccentric pin 30 has a slot 86, 88 for receiving a tool, such as a screwdriver, for adjusting the angular relationship between the two blades. Eccentric pin 30 is preferably formed of hardened steel.

Figure 7A:
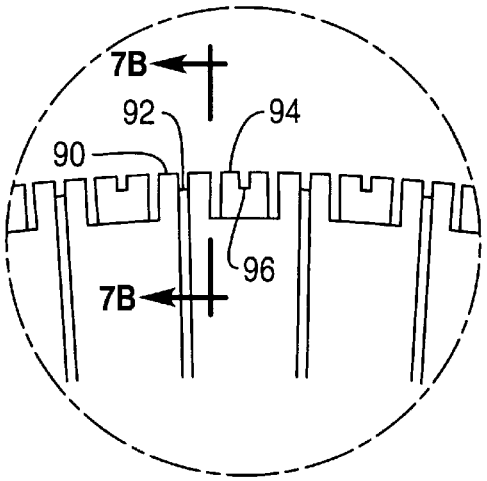
FIGS. 7A and 7B are detailed views of a second tooth arrangement for use with the first embodiment of the present invention.
Figure 7B:
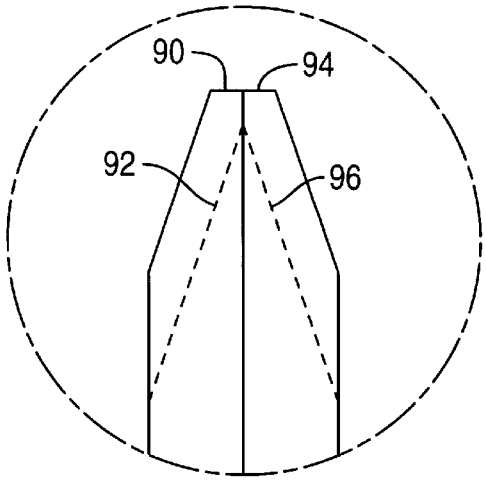

To assemble the perforation wheel assembly 10, the pair of perforation wheel cutting blades 20 and 22 are placed on perforation wheel mounting hub 24 so that the sharpened circumference of two blades adjacent to each other form a double bevel cutting blade (similar to that shown in FIG. 7B). The perforation mounting plate 26 is disposed opposite the hub 24, and the assembly is secured using the fasteners 28. The perforation wheel eccentric pin 30 locates the two cutting blades in a standard position.

As the eccentric pin 30 is rotated in the slots 64 and 74 of blades 22 and 20, the rotation causes an angular displacement of the two blade. By changing the angular relation of the two blades about the common center position formed by the hub, the space between teeth or the effective cutting tooth size are varied, providing a variable or adjustable cut and tie ratio.

The three holding holes 46 (shown in FIGS. 2A and 2B) can be used with a spanner wrench to prevent the complete assembly from turning when the fasteners are tightened or loosened or when setting the angular relationship of the two cutting blade wheels.

Scribed lines or machined marks can be added to the body for indication of the relative angular position of the two blades. Also, feeler type gauges or optical comparators can be used for setting the angular relation between the blades.

A center mounting hole 32 (shown in FIG. 1A) is provided for mounting the complete perforation wheel assembly. The complete assembly can be mounted on a commonly used air loaded perforation tool holder normally found on a business form press or collator. The tool holder can be purchased from the Economy Machine and Tool Company of Green Bay, Wis.

Referring to FIGS. 7A and 7B, a second arrangement for the teeth 90 and 94 of cutting blades is shown. Since the teeth include a small slot 92 and 96 respectively along the centerline of each tooth, the perforation assembly will perforate a multi-ply form producing a minimum of two different cut and tie perforation patterns at different levels (or different plies) producing a strata perforation. Small slots 92 and 96 are preferably cut at an angle to avoid breaking the very narrow teeth 90 and 94. The angle of the cut preferably corresponds to the angle of the blades and leaves grooves 92 and 96 down the angled portion of the blades 22 and 20 respectively, without effectively reducing the cutting strength of the teeth 90 and 94.

A second embodiment of the present invention is shown in FIGS. 8A through 11. Attention is first drawn to FIGS. 8A, 8B, 8C and 8D which show the perforation straight blade assembly 210 of the present invention. Perforation straight blade assembly 210 includes a pair of perforation straight blades 220 and 222. A blade alignment stud 228 and a blade retainer rivet 226 are used to maintain the alignment and to hold the assembled blades together. The blade alignment stud 228 is preferably a light press fit in fixed blade 222 and is preferably a slip fit with a slot 272 (shown in FIG. 10B) in movable blade 220. An adjustment tool 280 (shown in FIGS. 12A, 12B and 12C) fits in blades 220 and 222 and provides a means for adjusting the linear relationship between the pair of perforation blades 220 and 222.

Figure 9A:
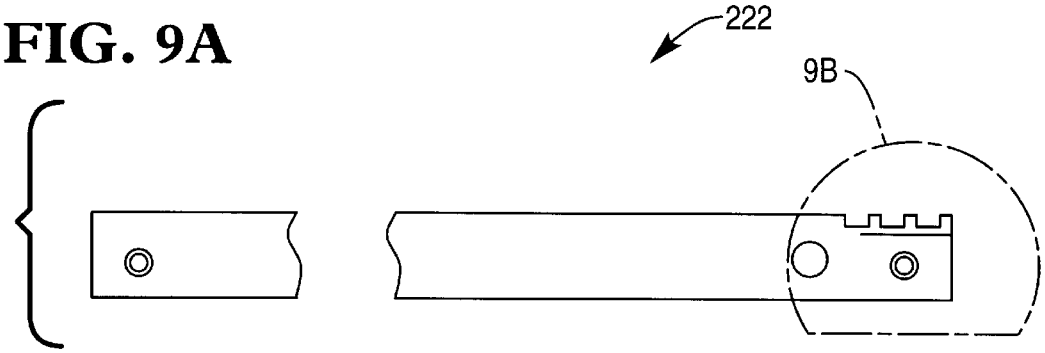
FIGS. 9A, 9B and 9C are detailed views of a fixed or first blade of the straight blade perforation assembly.
Figure 9B:
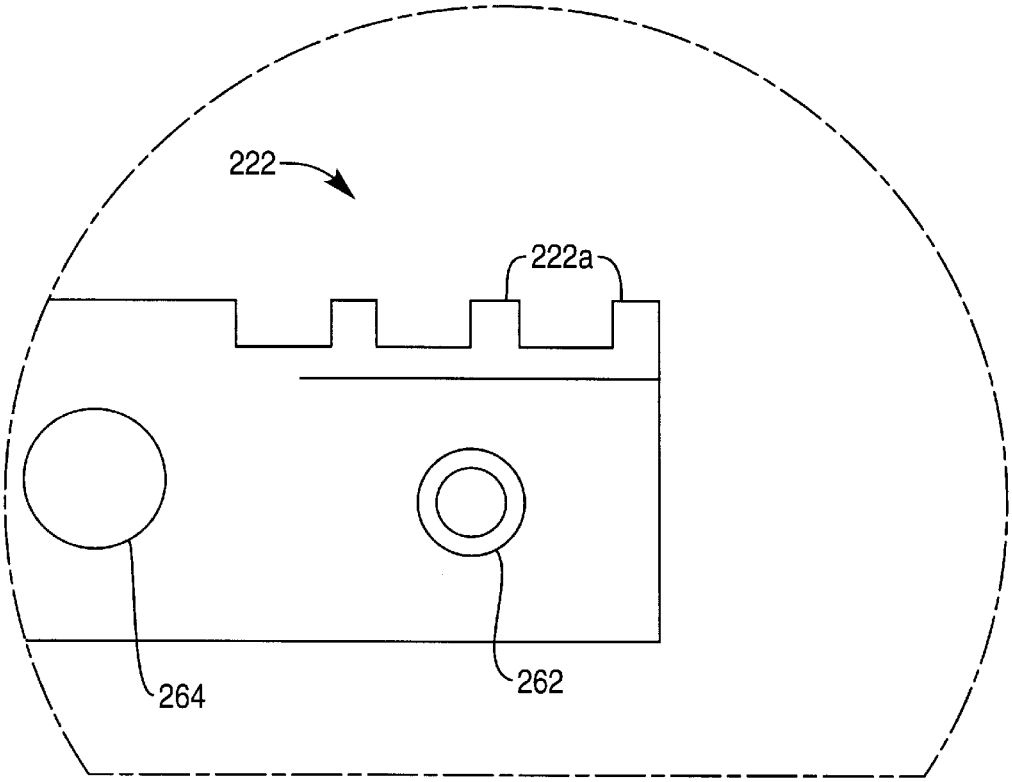
Figure 9C:
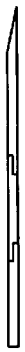

FIGS. 9A, 9B, 9C, 10A, 10B and 10C show detailed views of the blades 220 and 222. Blades 220 and 222 are preferably made from purchased blanks and preferably formed from high carbon steel having a Rockwell hardness of 54–57. Blades each have a beveled edge having a 15 degree angle from a small flattened area at the tip of each blade (similar to that shown in FIG. 4B). Each of the blades 220 and 222 have teeth 220*a*, 222*a* formed in one surface of each of the blades. FIGS. 9A, 9B and 9C show the fixed blade 222. Fixed blade 222 has an aperture 262 for receiving blade retainer rivet 226 and blade alignment stud 228. Fixed blade 222 also has an aperture 264 for the adjustment tool 280.

Figure 10A:
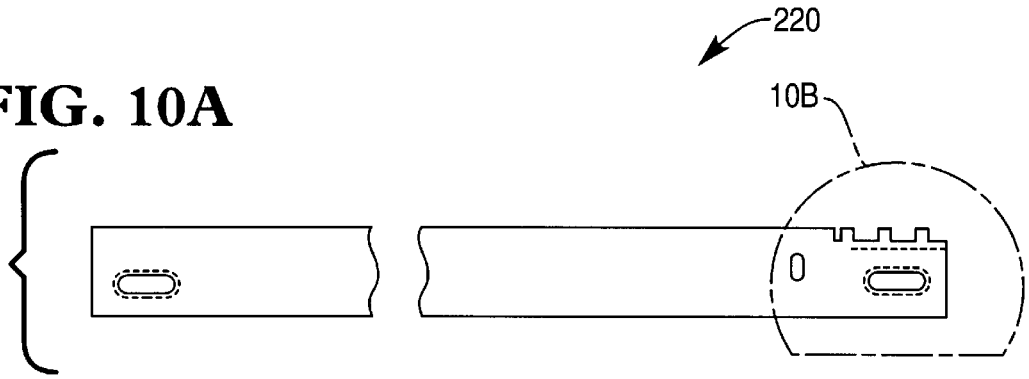
FIGS. 10A, 10B and 10C are detailed views of a movable or second blade of the straight blade perforation assembly.
Figure 10B:
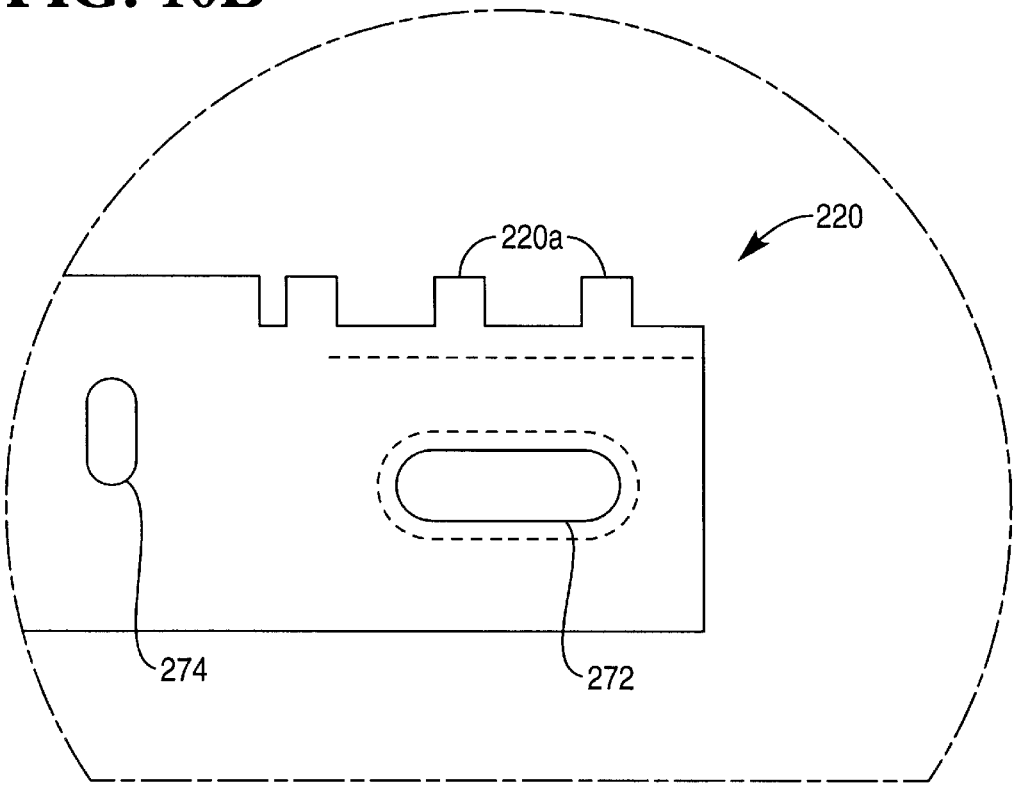
Figure 10C:
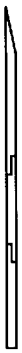

FIGS. 10A, 10B and 10C show the adjustable blade 220. Adjustable blade 220 has a slot 272 for receiving blade retainer rivet 226 and blade alignment stud 228 while still remaining adjustable. Adjustable blade 220 includes a larger slot 274 for the adjustment tool 280. Blades 220 and 222 are assembled so the flattened areas at the tips align and the beveled edge of each blade cooperates to form a beveled cutting edge (similar to that shown in FIG. 7B). Blades 220 and 222 preferably have between 5 and 50 teeth per inch, but may have any number of teeth required for the desired results. Blades preferably may be up to about 20 inches in length.

Figure 12B:
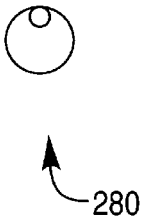
FIGS. 12A, 12B and 12C shows an adjustment tool for use with the second embodiment of the present invention.
Figure 12A:
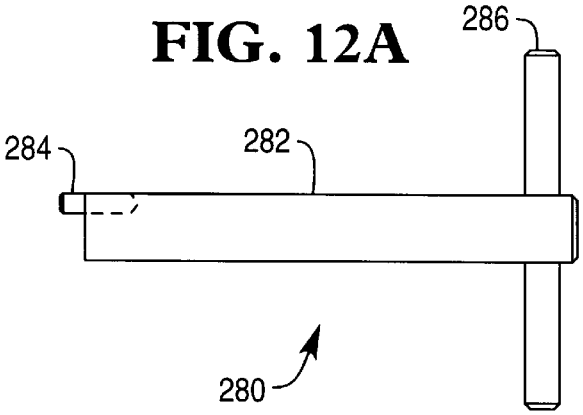
Figure 12C:
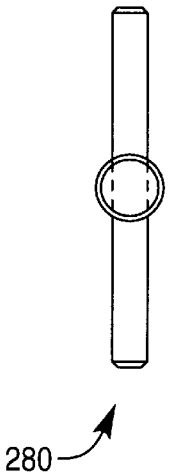

The linear relation of the two blades 220 and 222 can be changed using an eccentric pin type adjustment tool 280 as shown in FIGS. 12A, 12B and 12C. The tool 280 can be any type that adjusts the two blades using the round hole 264 in the fixed blade 222 and the slot 274 in the adjustable blade 220. The tool 280 preferably has a shaft 282 fitting through the hole 264 in the fixed blade 222 to maintain the position of the fixed blade and has a smaller post or eccentric pin 284 to adjust the position of the adjustable blade 220 with respect to the fixed blade. The adjustment tool 280 also includes a handle 286. By changing the linear relation of the two blades, the space between teeth or the effective cutting tooth size are varied, providing a variable size cut and tie ratio.

Scribed lines or machined marks can be added to either fixed blade 222 or movable blade 220 to indicate the linear displacement of the second blade with respect to the first blade. Also, feeler type gauges or optical comparators can be used to set the linear position of the moveable blade 220 relative to the fixed blade 222.

The complete straight perforation blade assembly 210 is used on a rotary printing press or rotary collator that is commonly used for the production of both single part or multi part business forms. The blade assembly can be fitted and clamped by a pressure bar into a cross perforation cylinder of either a standard press or a standard collator. The straight perforation blade assemblies 210 will normally be used in sets of two, three, four, five, six, seven, or eight within one cross perf. cylinder.

Figure 11:
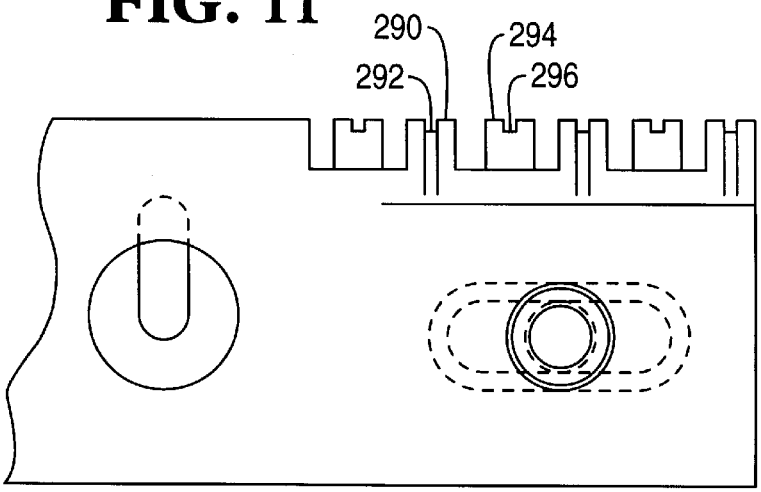
FIG. 11 is a detailed view of a second tooth arrangement for use with the second embodiment of the present invention.
Figure 8A:
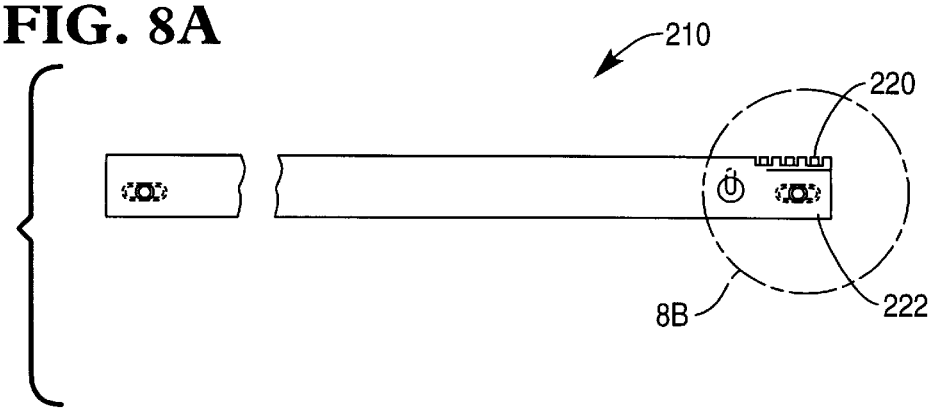
FIGS. 8A, 8B, 8C, and 8D are views of a straight blade perforation assembly according to a second embodiment of the present invention.
Figure 8B:
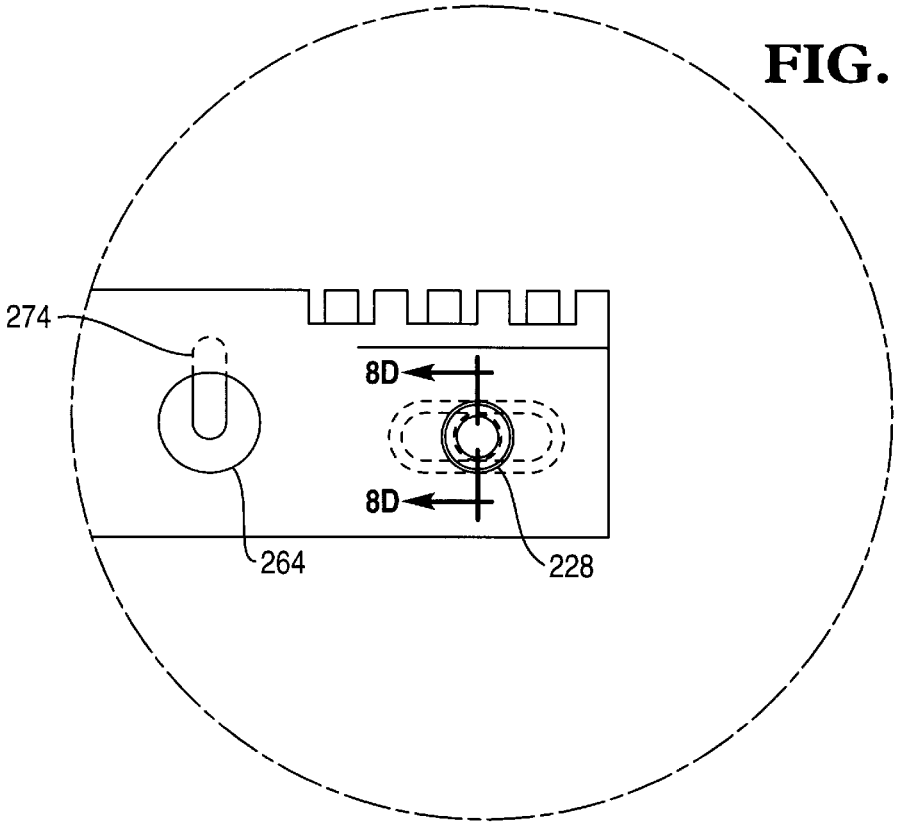
Figure 8C:
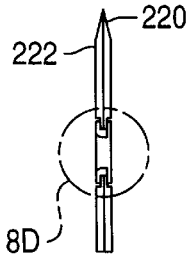
Figure 8D:
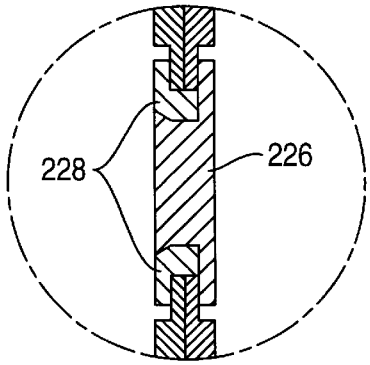

Referring to FIG. 11, a second arrangement for the teeth 290 and 294 of cutting blades 222 and 220 respectively, is shown. Since the teeth 290 and 294 include small slots 292 and 296 respectively along the centerline of each tooth, the perforation assembly will perforate a multi-ply form producing a minimum of two different cut and tie perforation patterns at different levels (or different plies) producing a strata perforation. Small slots 292 and 296 are preferably cut at an angle to avoid breaking the very narrow teeth 290 and 294. The angle of the cut preferably corresponds to the angle of the blades and leaves a groove down the angled portion of the blades 220 and 222 (similar to that shown in FIG. 7B) without effectively reducing the cutting strength of the teeth 290 and 294.

An advantage of the present invention is that the cutting blades, when used in pairs, provide an adjustable, virtually infinitely variable size perforation cutting assembly. The eccentric pin provides a convenient means to adjust the angular relationship between two rotary blades and the adjustment tool in conjunction with the slot and the hole provides a convenient means to adjust the linear relationship between two straight blades.

Another advantage of the present invention is that because two blades are used, it is possible to increase the size of the tooth space on each blade by an amount that is equal to the width of a cutting tooth. With one-half the number of teeth required on each of the two blades, the cut and tie sizes of a two piece blade assembly can be made to produce a cut and tie exactly the same as a one piece type blade but with less expensive construction. A smaller and deeper tooth space can be made with a two piece blade assembly than with a one piece blade.

Yet another advantage of the present invention is that an auxiliary tooth space can be added to the center portion of the cutting teeth. This enables the bottom ply or plies of a multi-ply form to be produced with a different perforation pattern than the upper plies. Thus weaker perforation patterns on the upper plies can be used to compensate for the additional force that is required to separate two to six parts over separating one to two part forms.

Still another advantage is that because it is possible to produce smaller perforations using blades with wider and deeper tooth space, the number of times that the cutting blades can be resharpened is greater.

Although the embodiments of the present invention have been described as including two blades, it is contemplated that additional blades may be used if desired.

Although the invention has been described with particular reference to certain preferred embodiments thereof, variations and modifications of the present invention can be effected within the spirit and scope of the following claims.

What is claimed is:

1. An adjustable perforation device for cutting perforations in a multi-ply form, comprising:

a first blade having a plurality of teeth, each of said plurality of teeth having a first predetermined length, said plurality of teeth being separated by a plurality of spaces, each of said plurality of spaces having a second predetermined length wherein said second predetermined length is greater than said first predetermined length; and a second blade having a plurality of teeth, each of said plurality of teeth having said first predetermined length, said plurality of teeth being separated by a plurality of spaces, each of said plurality of spaces having said second predetermined length wherein said second predetermined length is greater than said first predetermined length and with said spaces being wider than said teeth;

said first blade being attached to said second blade such that said plurality of teeth of said first blade do not overlap with said plurality of teeth of said second blade and wherein said plurality of teeth of said first blade are substantially the same height as said plurality of teeth of said second blade to provide a single perforation line in the multi-ply form which has smaller ties than either said first blade or said second blade could provide independently.

2. The adjustable perforation device of claim 1 wherein said device is a rotary wheel.

3. The adjustable perforation device of claim 2 wherein said first blade has an aperture and said second blade has an aperture and the device further includes an eccentric pin which fits into said aperture of said first blade and said aperture of said second blade and enables adjustment of the angular relationship of the first blade and the second blade.

4. The adjustable perforation device of claim 1 wherein said first and second blades are straight blades.

5. The adjustable perforation device of claim 4 wherein said first blade has an aperture and said second blade has a slot enabling an adjustment tool to move said slot relative to said aperture and enabling adjustment of the linear relationship of the first blade and the second blade.

6. The adjustable perforation device of claim 1 wherein each of said plurality of teeth of said first blade and said second blade have a beveled edge having a predetermined angle and wherein each of said plurality of teeth of said first blade and said second blade have a slot which is cut at said predetermined angle.

7. An adjustable perforation device for cutting perforations in a multi-ply form, comprising:

a first rotary blade having a plurality of teeth, each of said plurality of teeth having a first predetermined length, said plurality of teeth being separated by a plurality of spaces, each of said plurality of spaces having a second predetermined length wherein said second predetermined length is greater than said first predetermined length;

a second rotary blade having a plurality of teeth, each of said plurality of teeth having said first predetermined length, said plurality of teeth being separated by a plurality of spaces, each of said plurality of spaces having said second predetermined length wherein said second predetermined length is greater than said first predetermined length;

a mounting hub; and a retainer plate, wherein said first rotary blade and said second rotary blade are mounted between said mounting hub and said retainer plate so that said plurality of teeth of said first rotary blade do not overlap with said plurality of teeth of said second rotary blade to provide a single perforation line in the multi-ply form.

8. The adjustable perforation device of claim 7 wherein each of said plurality of teeth of said first rotary blade and said second rotary blade have a beveled edge having a predetermined angle and wherein each of said plurality of teeth of said first rotary blade and said second rotary blade have a slot which is cut at said predetermined angle.

9. An adjustable perforation device for cutting perforations in a multi-ply form, comprising:

a first straight blade having a plurality of teeth, each of said plurality of teeth having a first predetermined length, said plurality of teeth being separated by a plurality of spaces, each of said plurality of spaces having a second predetermined length wherein said second predetermined length is greater than said first predetermined length;

a second straight blade having a plurality of teeth, each of said plurality of teeth having said first predetermined length, said plurality of teeth being separated by a plurality of spaces, each of said plurality of spaces having said second predetermined length wherein said second predetermined length is greater than said first predetermined length; and means for attaching said first straight blade and said second straight blade so that said plurality of teeth of said first straight blade do not overlap with said plurality of teeth of said second straight blade to provide a single perforation line in the multi-ply form.

10. The adjustable perforation device of claim 9 wherein each of said plurality of teeth of said first straight blade and said second straight blade have a beveled edge having a predetermined angle and wherein each of said plurality of teeth of said first straight blade and said second straight blade have a slot which is cut at said predetermined angle.

* * * * *